US008747661B2

(12) United States Patent
Gurin

(10) Patent No.: US 8,747,661 B2
(45) Date of Patent: Jun. 10, 2014

(54) METHOD AND APPARATUS FOR OIL RECOVERY FROM TAR SANDS

(75) Inventor: Victor Gurin, Hollywood, FL (US)

(73) Assignee: Helpful Technologies Inc., Fort Lauderdale, FL (US)

( * ) Notice: Subject to any disclaimer, the term of this patent is extended or adjusted under 35 U.S.C. 154(b) by 331 days.

(21) Appl. No.: 12/657,357

(22) Filed: Jan. 19, 2010

(65) Prior Publication Data

US 2010/0181231 A1 Jul. 22, 2010

Related U.S. Application Data

(60) Provisional application No. 61/205,656, filed on Jan. 22, 2009.

(51) Int. Cl.
*C10G 1/04* (2006.01)

(52) U.S. Cl.
USPC ..... 208/390; 208/391

(58) Field of Classification Search
CPC ..... C10G 1/00; C10G 1/04; C10G 1/047
USPC ..... 208/390, 391
See application file for complete search history.

(56) References Cited

U.S. PATENT DOCUMENTS 3,553,098 A * 1/1971 Claridge ..... 208/390
4,108,760 A * 8/1978 Williams et al. ..... 208/390

* cited by examiner

*Primary Examiner* — Prem C Singh
*Assistant Examiner* — Michelle Stein
(74) *Attorney, Agent, or Firm* — Hershkovitz & Associates, PLLC; Abraham Hershkovitz; Eugene Rzucidlo

(57) ABSTRACT

A process for bitumen extraction from hydrocarbonaceous solids, such as tar sand or oil shale, is performed in fluidized bed of a swirl reactor. This provides active interaction of three phases: 1) liquid phase—bituminous oil with solvent; 2) solid phase—sand grains, clay; 3) gaseous phase—steam and gasses. The process also involves the step of pressure decrease inside the reactor to activate a gas desorption dissolved in bituminous sand mixture. The process of separation of the bitumen and sand combines centrifuging and discharging individual products for further processing.

7 Claims, 1 Drawing Sheet

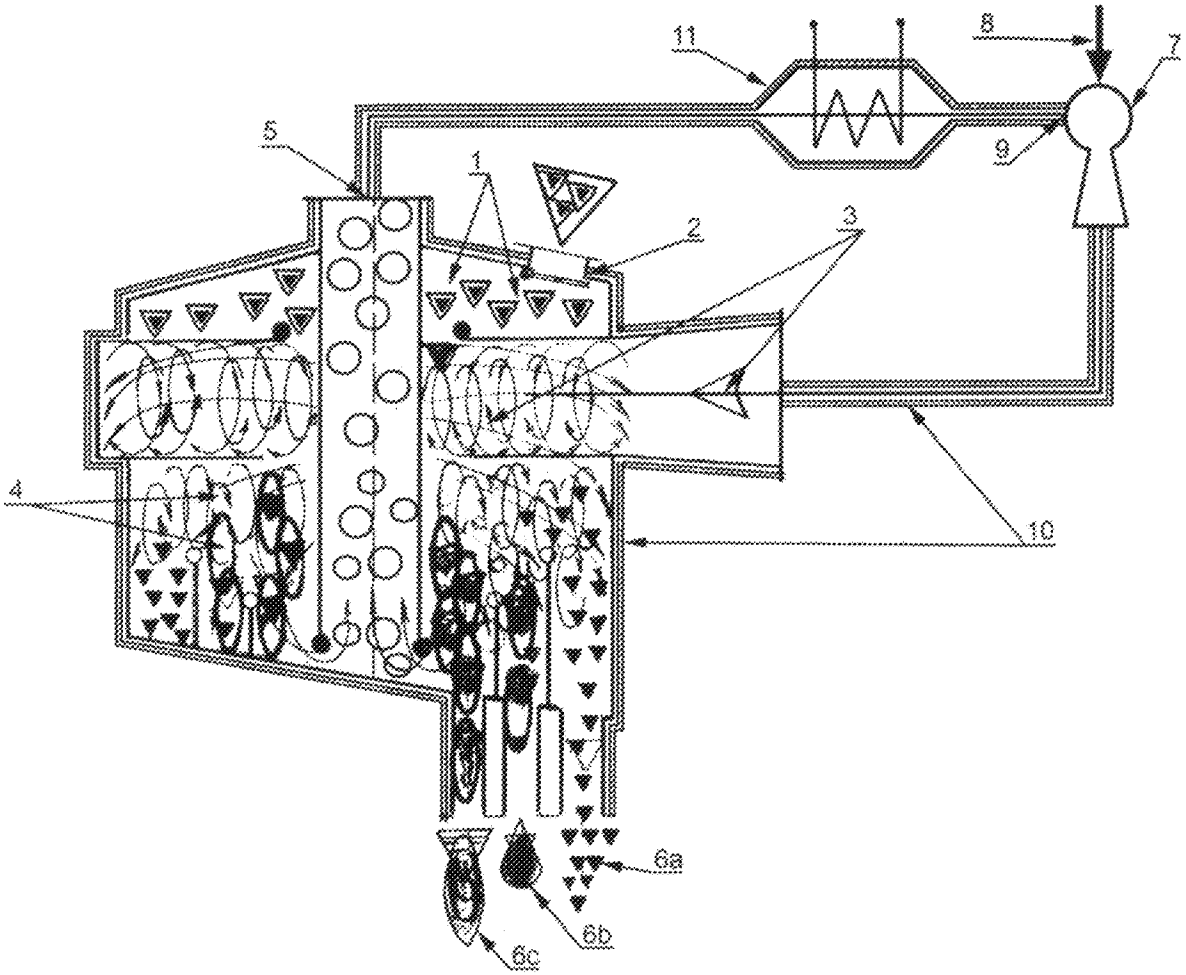
7
8
9
11
10
3
2
1
5
4
6a
6b
6c

METHOD AND APPARATUS FOR OIL RECOVERY FROM TAR SANDS

CROSS REFERENCE TO RELATED APPLICATIONS

This application claims the benefits of U.S. Provisional Patent Application No. 61/205,656, filed on Jan. 22, 2009.

FIELD OF THE INVENTION

This invention relates to bitumen separation from oil sands or oil shales.

BACKGROUND OF THE INVENTION

The current industry practice for extracting bitumen from oil sands and the like is the hot water process. This process typically involves pre-crushing as-mined oil sands and conditioning the oil sands by mixing it with large amount of hydrocarbon diluent. Next step is based on heating oil sands with hot water and steam to yield a slurry. During this step bitumen flecks became less viscous. Bitumen flecks separate mainly from the surface and partially from pores of the sand grains. This process is done in a rotating kiln with continuous agitation of the raw material. Inside the kiln there are blade that while rotating agitate the sand and move it to the lower part of the kiln. The liquid bitumen slurry concentrate at the bottom of the inclined kiln. The saturated steam and raw material are both supplied to the inlet port of the kiln. The bitumen slurry is discharged from the bottom outlet port of the kiln. The typical sized of the working zone of the inclined rotating kilns are 2.5 m in diameter and up to 20 m in length. To better separate the bitumen product two or more stages of the hot water and steam treatment can be used.

The heat losses of such plants can reach up to 30% as components are supplied and discharged at partially open ports as well as significant heat losses are due to design of the working zone of the kilns.

The main reasons that prevent the usage of such technology are:

1) power requirements by this technology is 5.5-8 times higher than the ones at extracting conventional oil;

2) significant soil and ground water contamination resulting from disposal of tailing streams containing some residual amount of bitumen to large tailing ponds;

3) high emissions of combustion products such as $CO_2$, $NO_x$, CO, etc. at production of the technical saturated steam.

SUMMARY OF THE INVENTION

With the background in mind we have devised a new method for processing crushed as-mined oil sands in fluidized bed swirl reactor with simultaneous effect of gaseous swelling of bituminous material. The suggested method is based on the fact that mass exchange process of oil sands and working environment—the saturated steam—is performed in fluidized bed. Before supplying to the swirl reactor the crushed oil sands is mixed with the liquid hydrocarbonaceous solvent with dissolved carbon dioxide $CO_2$. Carbon dioxide or the mix of gasses for dissolving in liquid hydrocarbonaceous solvent is exhaust gases of a steam generator. In this step the three-component "oil sand+hydrocarbonaceous solvent+$CO_2$" mixture is prepared where $CO_2$ is sorbed by bituminous material containing in porous sand grains. The prepared three-component mixture is then supplied through a hydraulic back-pressure valve to working zone of the swirl reactor.

The saturated steam is injected at high pressure in the working zone of the reactor through tangential inlet and directed to an impeller with guiding blades that create a turbulent flow of the saturated steam. The three-component mixture supplied to the working zone is suspended in the steam flow. This significantly increases the heat transfer to the oil sand grains. Periodical pressure decrease inside the reactor up to atmospheric pressure gives additional effect to the oil sand grains, i.e. $CO_2$ desorption from the liquid bituminous slurry. The initial centers of gas desorption are the contact surface of oil sand grains and liquid phase (bitumen). The gas, released mainly at the solid-liquid contact surface, breaks off and forces out the liquid phase, the bitumen, from the grain pores. Double effect of breaking-off and "swelling" makes it easier to separate bitumen and sand grains—allow full separation in 3 to 4 steps.

Other objects, features and advantages of the present invention will be apparent from the accompanying drawing, and from the detailed description that follows below.

BRIEF DESCRIPTION OF THE DRAWING

FIG. shows a schematic diagram of a preferred embodiment of a separation apparatus—swirl reactor "Tornado".

DETAIL DESCRIPTION OF THE DRAWING

The main element on this diagram is a swirl gas/liquid reactor operating at a pressure up to 35 psi. There are several zones in the reactor. The crushed oil sands from mining or drilling operation is fed into feeding zone 1 having discrete lock 2. The saturated steam is fed into impeller zone 3 through tangential inlet port. Both oil sands and steam are contacted in the swirl zone 4. Exhaust steam is removed from the reactor through axial outlet port 5. Outlet ports 6*a*, 6*b*, 6*c* are used to discharge separated products: solids, solids and liquid phase, liquid phase, accordingly. Check valves are provided on each of the ports for feeding and removing the steam, and discharging separated products.

In the feeding zone 1 of the swirl reactor the oil sands is mixed with a solution of hydrocarbonaceous component with exhaust gases having $CO_2$ from a steam generator (not shown). Keeping a contact for preset time provide sorption of the $CO_2$ by bitumen located on the surface and in the pores of the sand grains. The such prepared three-component oil mixture is then supplied to the swirl zone 4 through discrete lock 2. The saturated steam fed through the tangential inlet port is directed to the impeller zone 3. There are provided guiding tangential blades at different angles in horizontal and vertical planes. Such arrangement of the tangential impeller blades across steam flow creates space whirl flows. With preset time period three-component mixture from feeding zone is fed to the swirl zone 4. Because of the high speed steam flow the sand grains become suspended in the steam flow. The interaction with the whirl steam flows creates centrifugal forces acting on the suspended sand grains. The effect of high temperature and hydrocarbonaceous solvent make bitumen less viscous To stimulate degassing the pressure inside the reactor is periodically decreased up to atmospheric. This allow releasing $CO_2$ dissolved on previous step in the three-component oil mixture. The initial centers of gas desorption are the contact surface of oil sand grains and liquid phase (bitumen). The gas, released mainly at the solid-liquid contact surface, breaks off and forces out the liquid phase, the bitumen, from the grain pores. Double effect of breaking-off and "swelling" makes it easier to separate bitumen and sand grains. That allow separate fractions having different density, e.g. separated bitumen and sand grains and discharge them at optimal radii of the reactor axis (ports 6*a*, 6*b*, and 6*c*).

To organize the steam recirculation there is provided a steam jet pump 7. The fresh steam saturated steam, e.g., from a steam generator (not shown), is directed to a high pressure inlet port 8 while recirculated exhaust steam from the swirl reactor is directed to a suction port 9 of the steam jet pump 7. To reduce heat losses the connection lines are insulated (10). Because the temperature of the exhaust steam after the swirl reactor may drop significantly a heat exchanger 11 is provided in the recirculation line.

The small size and making a process in close volume gives many advantages to this technology. Calculation and first tests of the pilot apparatus show that separation of the bitumen and sand components by the "fluidized bed" technology requires dramatically, in 4.3-5 times, less saturated steam while providing more full extraction of the final product, the bitumen, up to 98.5% with two stages of separation. There are no moving parts making this process less mechanically intensive and subsequently more economical to operate, compared to other bitumen recovery processes.

The invention is capable of other and different embodiments, and its several details are capable of modifications in various respects, all without departing from the invention. Accordingly, the drawing and description of the preferred embodiment are illustrative in nature and not restrictive.

I claim:

1. A method for processing oil sands in a vortex gas/liquid reactor comprising:

a) mixing oil sands with liquid hydrocarbonaceous solvent containing dissolved carbon dioxide $CO_2$ to form a three-component oil sand mixture comprising oil sands, hydrocarbonaceous solvent, and $CO_2$ wherein $CO_2$ is sorbed by bituminous material contained in porous sand grains of the oil sands;

b) supplying the three-component mixture to a working zone of the the vortex gas/liquid reactor;

c) injecting saturated steam into the working zone of the reactor through an inlet and directing the saturated steam to an impeller to create a turbulent flow of the saturated steam;

d) suspending the three-component mixture in the working zone in the saturated steam flow; and e) separating from the vortex gas/liquid reactor a liquid phase comprising bitumen and hydrocarbonaceous solvent containing $CO_2$ and a solid phase comprising $SiO_2$.

2. A method according to claim 1, further comprising repeating the method in subsequent recovery cycles for each outgoing product of a first cycle for full separation of oil product from the solid phase.

3. A method according to claim 1, further comprising processing the the three-component oil sand mixture in the vortex gas/liquid reactor under an excessive pressure as a rotating and actively agitating suspension of the the three-component oil sand mixture, supplying the saturated steam through a guiding impeller, and loading the three-component oil sand mixture through a feeder of the reactor at upper plate of the impeller.

4. A method according to claim 3, further comprising loading the the three-component oil sand mixture through the feeder under the excess gas pressure and stopping the fresh saturated steam supply and saturated steam removal from the reactor, wherein during the stopping, gases are absorbed by the liquid phase of the three-component oil sand mixture.

5. A method according to claim 4, wherein after gas sorption supplying the saturated steam through the impeller, the three-component oil sand mixture are loaded to the working zone from the impeller, exhaust saturated steam is removed through the axial channel of the reactor, decreasing the gas pressure below a pressure level during gas sorption by the ground raw oil containing/solvent/$CO_2$ mixture, desorbing gases from the liquid phase at decreased pressure and performing gas removal inside the pores on the border of the solid phase - liquid phase, wherein the liquid phase is broken off the surface of the solid phase and forced out of the pores by the gas.

6. A method according to claim 5, wherein at the same time with gas desorption, the three-component oil sand mixture and oil-free solid phase, $SiO_2$, are separated due to their different densities in an intensively rotating cloud of a suspended mixture of bitumen +$SiO_2$ +saturated steam+$CO_2$ +air; and the separated liquid product is unloaded at a lesser radius of the cloud whereas the heavier solid phase is unloaded at maximal radius of the circulating cloud inside the reactor.

7. A method according to claim 4, wherein the vortex gas/liquid reactor has a heat insulation loop with recirculating saturated steam; the exhaust saturated steam from the reactor goes through a saturated steam jet pump saturated steam heater, fresh saturated steam from an external source is supplied of the saturated steam jet pump; and the mixed stream from the saturated steam jet pump is directed to the impeller of the reactor.

* * * * *